United States Patent [19]

Kent et al.

[11] Patent Number: 4,613,844

[45] Date of Patent: Sep. 23, 1986

[54] HIGH POWER RF THICK FILM RESISTOR AND METHOD FOR THE MANUFACTURE THEREOF

[75] Inventors: Edward J. Kent; Dorris F. Lore, both of Marlton; Eugene J. Viereck, Jr., Gloucester, all of N.J.

[73] Assignee: RCA Corporation, Princeton, N.J.

[21] Appl. No.: 769,145

[22] Filed: Aug. 26, 1985

[51] Int. Cl.[4] ..... H01C 1/012; H01C 1/01; H01C 17/00

[52] U.S. Cl. ..... 338/314; 29/610 R; 338/320; 338/309

[58] Field of Search ..... 338/321, 322, 323, 324, 338/325, 326, 327, 328, 329, 330, 331, 332, 314, 320, 308, 309, 307; 29/620, 621, 610 R; 361/307

[56] References Cited

U.S. PATENT DOCUMENTS 4,107,632 8/1978 Dawson ..... 333/81 A
4,245,210 1/1981 Landry et al. ..... 338/314
4,300,115 11/1981 Ansell et al. ..... 338/314

*Primary Examiner*—E. A. Goldberg
*Assistant Examiner*—Linda M. Peco
*Attorney, Agent, or Firm*—Birgit E. Morris; Donald S. Cohen

[57] ABSTRACT

An improved thick film resistor is disclosed which is comprised of a substrate, a resistor body comprised of a plurality of overlying layers of a resistor material, and a pair of spaced apart terminals each of which has a primary contact portion and a plurality of spaced apart secondary contact portions. The secondary contact portions are interleaved between the layers of resistor material and extend partially into the resistor body and are in electrical and heat transferring contact with the respective primary contact portions of each terminal. The novel thick film resistor is compact in its dimensions and is capable of dissipating substantially large amounts of heat and providing lower current densities than conventional thick film resistors.

6 Claims, 2 Drawing Figures

HIGH POWER RF THICK FILM RESISTOR AND METHOD FOR THE MANUFACTURE THEREOF

The Government has rights in this invention pursuant to Contract No. N00024-80-C-5108 awarded by the Department of the Navy.

This invention relates to a novel high power radio frequency (RF) resistor, and more particularly is concerned with a thick film resistor having a relatively small surface area, substantially improved resistance stability, and increased peak power handling capacity as compared to conventional thick film resistors.

BACKGROUND OF THE INVENTION

The term "thick film resistor" as used in the electronic industry refers to the method used to fabricate a resistor rather than the relative thickness of the individual layers of material which comprise the resistor. In the manufacture of thick film resistors, especially formulated pastes are typically applied and fired in a predetermined sequence on a ceramic substrate. These pastes include conductor pastes and resistor pastes. The conductor pastes are typically comprised of fine particles of a highly conductive metal, such as gold or a gold alloy, and an organic carrier. When a layer of a conductive paste is fired, the organic carrier is burned off and a conductive metal layer is formed. The resistor pastes are typically comprised of a mixture of two principal components, a dielectric glass frit and an electrically conductive powder. When a layer of resistor paste is fired, the glass frit is fused and a layer of resistor material is obtained having a glassy matrix with conductive particles distributed through the matrix. The layer of resistor material will have an ohmic value which is dependent to a large extent on the composition and distribution of the conductive particles in the resistor layer.

When making a conventional thick film resistor, the conductive paste is initially printed on the ceramic substrate in a predetermined pattern and fired to form a pair of spaced apart terminals. Thereafter usually a single layer of a resistor paste is applied between and over a portion of the previously formed terminals and the layer of resistor paste is fired to form a fused resistor body.

The selection of a particular resistor paste for use in the manufacture of a thick film resistor is determined by a number of interrelated factors, such as the ohmic value desired for the completed resistor; the frequency of the current at which the resistor will be exposed; the temperature at which the resistor is expected to operate; and the average power and maximum peak power surges the resistor is anticipated to encounter in use.

The effective ohmic value of a resistor layer is determined to a large extent by the frequency at which the resistor is used. If the frequency is in the RF range, power fed to the resistor will travel almost exclusively along the skin of the resistor layer rather than through the bulk of the resistor body. For this reason, when selecting a resistor material for RF applications, the resistance of the surface area, commonly referred to as the sheet resistance value, is used as a guide in the selection of the resistor material since the sheet resistance of a layer of a fired resistor paste will generally be closely related to the resistance of the final thick film resistor.

The effective ohmic value of a resistor is also highly dependent on the temperature at which the resistor is employed. With most resistor materials, the higher the temperature at which the resistor is operated, the higher the resistance will be. Since it is generally desired to have a constant resistance, it is preferable that the resistors operate at a selected relatively low temperature. Excessively high operating temperatures are a serious problem because the excessively high temperatures can cause electrical breakdown of the resistor body and result in arcing across the resistor.

To fabricate conventional thick film resistors capable of handling relatively high power in the RF range, it is common practice to increase the surface area of the resistor by widening and/or lengthening the resistor. The increased area of the resistor obtained thereby can result in greater dissipation of heat, allowing the resistor to operate at a lower temperature. This approach, while effective in certain applications, has not been proven to be entirely satisfactory however, particularly in high power microelectronic applications, in that the amount that the area of the resistor has to be increased to be effective in maintaining relatively low temperatures can often result in an excessively large area resistor which is unsuitable for microelectronic applications.

An additional cause of failure of resistors, particularly those employed in high power applications, is excessively high current density at various portions of the resistor. One of the areas of a resistor where excessively high current densities are commonly encountered is at the junction of the terminal with the body of the resistor material.

Various suggestions have been made to improve the performance of thick film resistors. One especially notable suggestion was made by Landry et al. in U.S. Pat. No. 4,245,210 entitled "Thick Film Resistor Element And Method Of Fabricating." Landry et al., suggest using three or more distinct overlying layers of resistive material with the bottommost layer being in electrical contact with the terminals of the resistor. The Landry et al. thick film resistor was a significant advance in the resistor art in that it resulted in a resistor which was substantially more compact than the equivalent conventional single layer resistors that were previously employed. The Landry et al. resistor has not, however, proven to be completely satisfactory, especially in high power resistor applications where extremely high peak power loads are encountered and large amounts of heat are produced because Landry et al.'s resistors tend to break down under these conditions.

What would be highly desirable for high power resistor applications is a compact thick film resistor capable of dissipating substantial amounts of heat and reducing operating current densities.

SUMMARY OF THE INVENTION

An improved thick film resistor is disclosed which is comprised of a substrate, a resistor body comprised of a plurality of overlying layers of a resistor material, and a pair of spaced apart terminals each of which has a primary contact portion and a plurality of spaced apart secondary contact portions. The secondary contact portions of the terminals are interleaved between the layers of resistor material and extend partially into the resistor body. The secondary contact portions are also in electrical and heat transferring contact with the respective primary contact portions of their respective terminals. The novel thick film resistor of this invention is compact in its dimensions and is capable of dissipating substantially large amounts of heat at lower current densities than conventional thick film resistors.

DETAILED DESCRIPTION OF THE INVENTION

Figure 1:
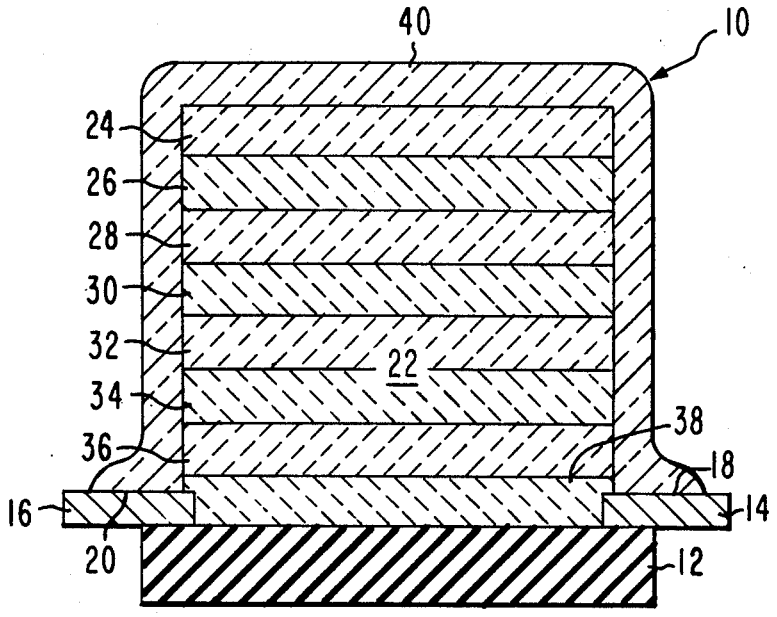
Fig. 1 (PRIOR ART)
FIG. 1 is a front elevational view in cross section of a prior art thick film resistor.

In FIG. 1 there is an illustration of the Landry et al. resistor 10 as disclosed in U.S. Pat. No. 4,245,210. The Landry et al. resistor 10 is comprised of the same basic structural components as conventional thick film resistors. The Landry et al. resistor 10 includes a substrate 12, a pair of spaced apart terminals 14, 16 with contact portions 18, 20 and a resistor body 22. The Landry et al. resistor 10 differs substantially, however, from conventional prior art resistors in that the resistor body 22 is made of a plurality of distinct layers 24, 26, 28, 30, 32, 34, 36 and 38, each of which is in electrical contact with adjacent layers. However, only the bottom-most layer 38 is in direct contact with contact portions 18, 20 of the terminals 14, 16. A layer of a hermetically sealing dielectric material 40 is applied over the resistor body 22 and the contacts 18, 20 of the Landry et al. resistor 10.

Figure 2:
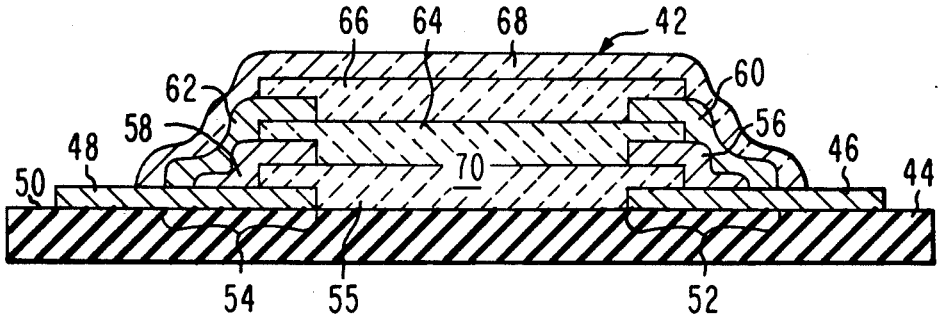
FIG. 2 is a front elevational view in cross section of a thick film resistor of the present invention.

The Landry et al. resistor 10 is different in construction and in operation from the resistor of this invention 42 illustrated in FIG. 2. However, it has been found that the materials, thicknesses and the like suggested for use in the formation of substrate, terminals, resistor layers, and dielectric layer in the Landry et al. resistor 10 are also well suited for use in the thick resistor of this invention 42 and according to the teachings in the Landry et al. patent as to these features are incorporated herein by reference in this specification.

Turning specifically to FIG. 2 there is shown the thick film resistor of this invention 42. The resistor of this invention 42 has a substrate 44 which can be made of various electrically insulative and heat conductive materials, with beryllium oxide being the most preferred material. The shape of the substrate 44, as illustrated, is relatively thin and of a rectangular shape. It has been found in practice, however, that the precise shape of the substrate 44 can be varied considerably depending upon the applications in which the resistor will be employed. Furthermore, since the primary function of the substrate 44 is to act as a heat sink, it is advantageous that the substrate 44 have additional mass as compared to conventional resistors and those of the Landry et al. resistor so as to dissipate the additional heat generated when utilizing the enhanced power handling capability of the resistor of this invention 42.

A pair of opposed spaced apart terminals 46, 48 are attached to a surface 50 of the substrate 44. Each of the terminals 46, 48 has elongated contact portions 52, 54 of sufficient length to make electrical contact with a first layer of resistor material 55 and a predetermined number of layers of secondary contacts 56, 58, 60, 62, as explained hereinafter.

The first layer of resistor material 55 extends between the spaced apart terminals 46, 48 and over a section of the primary contact portions 52, 54.

A first pair of secondary contacts 56, 58 are formed over a portion of the first layer of resistor material 55. The first pair of secondary contacts 56, 58 extend to the primary contact portions 52, 54 of their respective terminals 46, 48 where they are in electrical and heat transferring contact with the primary contact portions 52, 54.

A second layer of resistor material 64 is formed over the exposed surfaces of the first pair of secondary contact portions 56, 58 which overlies the first layer of resistor material 55.

A second pair of secondary contact portions 60, 62 are formed over a section of the second layer of resistor material 64 and extend into electrical and heat transferring contact with the primary contact portions 52, 54 of their respective terminals 46, 48.

A third layer of resistor material 66 is formed over the second pair of secondary contacts 60, 62.

If desired, additional alternating layers of secondary contacts and layers of resistor material can be used to obtain a resistor having a specified ohmic value. It has been found, however, that optimum results are generally obtained with the structure shown in FIG. 2 which includes the substrate 44, three layers of resistor material 55, 64, 66 and a pair of terminals 44, 46 each having primary contact portions 52, 54 and a pair of interleaved secondary contact portions 56, 58, 60, 62.

To protect the completed resistor structure, it is preferable to form a final layer of a hermetically sealing dielectric layer 68 over the resistor layers 55, 64, 66 and contacts 56, 58, 60, 62.

As can be seen in FIG. 2, the resistor of this invention 42 has unique terminal structures with the pairs of secondary contacts 52, 54, 56 and 58 interleaved between the layers of resistor material 55, 64 and 66 and extending partially into the resistor body 70.

It has been found from practice that to obtain the optimum operation of the resistor 10 that each of the secondary contact portions 56, 58, 60 and 62 should extend into the resistor body 70 for a distance of about a tenth of the total width of the resistor body 70.

While the exact reason that the resistor of this invention 42 has superior high power handling capability is not known for certain and is not relied on for purposes of establishing patentability, it is believed that the unique terminal structure with the secondary contact portions significantly increases the rate of dissipation of heat to the substrate and increases the area of electrical contact so as to reduce localized areas of high current density. It has been found, for example, that the resistor of this invention 42, when compared to an equivalent resistor made according to the teachings of Landry et al., had increased net resistance stability over increased applied power levels and an increase in peak power handling of about 70 percent.

What is claimed is:

1. In a thick film resistor having (a) an electrically insulative thermally conductive substrate; (b) a pair of opposed spaced apart terminals attached to a surface of the substrate with each of said terminals including a primary contact portion; and (c) a resistor body extending between the terminals and being electrically connected with the respective primary contact portion of each terminal, and being formed of a plurality of overlying layers of a resistor material with the adjacent layers thereof in electrical contact; the improvement which comprises: each of said terminals further including a plurality of spaced apart elongated secondary contact portions in electrical and heat transferring connection with the primary contact portion of the respective terminals and being interleaved between the layers of said resistive material and extending partially into the resistor body.

2. The thick film resistor of claim 1 which further included a hermetically sealing layer of a dielectric over the resistor body and the contacts.

3. The thick film resistor of claim 1 which includes at least three layers of resistor material and at least two secondary contacts on each terminal with said contact portions being interleaved with alternating layers of resistor material.

4. The thick film resistor of claim 1 wherein each of the secondary contact portions extends into the resistor body to a point about one tenth of the total width of the resistor body.

5. The method for the manufacture of a thick film resistor comprising the steps of:

forming on a surface of an electrically insulative thermally conductive substrate a pair of spaced apart terminals each of which includes a primary contact portion;

forming a first layer of a resistive material between the terminals in electrical contact with the primary contact portion;

forming a secondary contact portion at each terminal in contact with a portion of the surface of the layer of resistor material and in electrical and heat transferring contact with the respective primary contact portions;

forming a layer of resistor material over the previously formed layer of resistor material and the contact portion formed on the surface of the layer; and thereafter alternately forming additional secondary contact portions and additional layers of resistive material until a thick film resistor having a predetermined resistivity is obtained.

6. The method according to claim 5 wherein after said thick film resistor having the predetermined resistivity is obtained a layer of a hermetically sealing dielectric layer is applied over the resistor layers and the contacts.

* * * * *